US005477903A

United States Patent [19]

Figueiredo et al.

[11] Patent Number: 5,477,903

[45] Date of Patent: Dec. 26, 1995

[54] ACCORDION STORM SHUTTER

[75] Inventors: Pedro Figueiredo, Sunrise; Larry Verdon, Miramar; Norberto Valea, Miami, all of Fla.

[73] Assignee: Wrono Enterprise Corporation, Hallandale, Fla.

[21] Appl. No.: 252,559

[22] Filed: Jun. 1, 1994

[51] Int. Cl.[6] ..... E05D 15/26

[52] U.S. Cl. ..... 160/183; 160/233

[58] Field of Search ..... 160/183, 233, 160/235, 196.1, 199, 206, 236, 229.1, 213, 113, 114, 118, 119, 135

[56] References Cited

U.S. PATENT DOCUMENTS

| | | | |
|---|---|---|---|
| 2,641,018 | 6/1953 | Snyder | 160/235 |
| 3,335,784 | 8/1967 | Risk et al. | 160/199 |
| 3,359,594 | 12/1967 | Pastoor | 160/235 X |
| 3,529,651 | 9/1970 | Bender | 160/183 |
| 3,799,237 | 3/1974 | Proserpi | 160/199 |
| 4,386,645 | 6/1983 | Dever et al. | 160/183 |
| 5,036,953 | 8/1991 | Munz | 160/196.1 X |

*Primary Examiner*—David M. Purol
*Attorney, Agent, or Firm*—Shoemaker & Mattare, Ltd.

[57] ABSTRACT

An accordion storm shutter assembly includes a frame for installation in an opening in a building wall and at least one folding shutter supported by the frame. The shutter is made up of plural blades articulated along their vertical edges so that the shutter can fold from a closed position in which the blades made a substantial angle—about 75°—with one another so as to have a corrugated configuration blocking the opening, to an open position in which the blades are substantially parallel to one another. Neighboring blades are interconnected by continuous, extruded linear hinges, each having a socket which is substantially an arc of each cylindrical shell having a vertical axis. A knuckle formed along one edge of a neighboring blade pivots in the socket.

10 Claims, 9 Drawing Sheets

CLOSE POSITION

OPEN POSITION

ACCORDION STORM SHUTTER

BACKGROUND OF THE INVENTION

This invention relates generally to closures, and more particularly to an accordion-type metal storm shutter.

There are code requirements in Florida and other jurisdictions for storm shutters. The south Florida building code, applicable to Dade and Broward counties, specifies that storm shutters must be able to withstand the impact of a two-by-four, weighing nine pounds, moving at 50 feet per second, simulating the impact of debris during a hurricane. There are also standards for the ability to withstand wind pressure, including negative pressures, and fatigue loading tests. Many older steel roll shutters and the like are not capable of meeting these specifications.

SUMMARY OF THE INVENTION

An object of the invention is to provide a strong storm shutter capable of withstanding impacts from flying debris during tropical storms and high wind load pressures.

Another object of the invention is to provide a shutter which is attractive, and easy to operate.

A further object of the invention is to help prevent house break-ins.

These and other objects are attained by the accordion storm shutter assembly described in detail below. The assembly includes a frame for installation in an opening in a building wall and at least one folding shutter supported by the frame and comprising plural blades articulated along vertical edges whereby the shutter can fold from a closed position in which the blades make a substantial angle with one another so as to have a corrugated configuration blocking the opening, to an open position in which the blades are substantially parallel to one another. Neighboring blades subtend an angle of about 75° when the shutter is closed; they are interconnected by continuous extruded linear hinges, each comprising a socket which is substantially an arc of a cylindrical shell having a vertical axis, said socket having a longitudinal gap therein, and a knuckle adapted to turn within the socket and having a blade arm extending therefrom through the gap.

BRIEF DESCRIPTION OF THE DRAWINGS

In the accompanying drawings.

DESCRIPTION OF THE PREFERRED EMBODIMENT

An accordion storm shutter embodying the invention includes a rectangular frame 10 (FIG. 1) comprising a top member 12, a pair of geometrically similar side members 14,16, and a bottom member 18. These parts are custom cut, or precut, to fit a window or door opening in a building. Each of the frame members is extruded from, preferably, an aluminum alloy.

Figure 4:
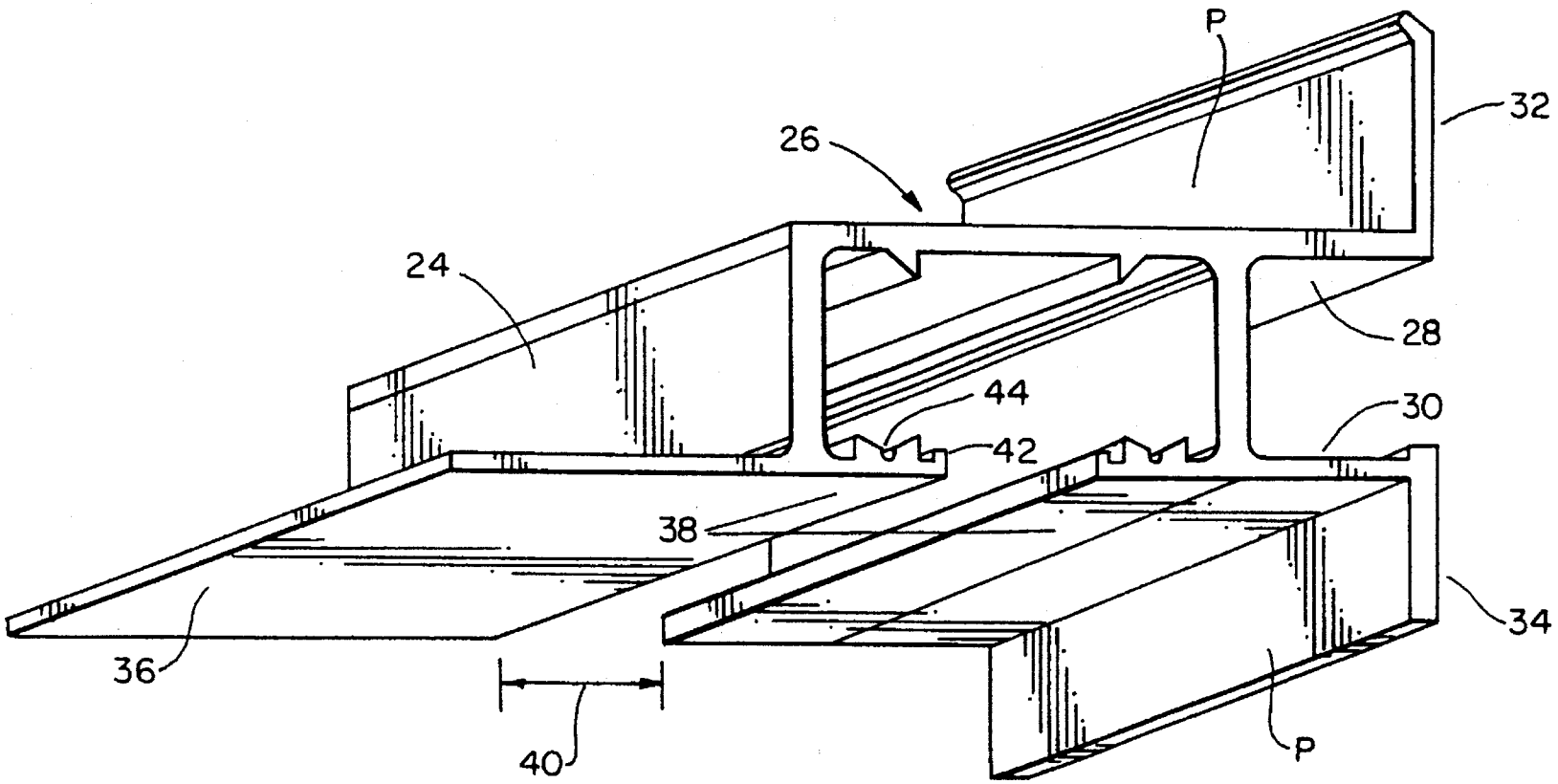
FIG. 4 is a perspective view of a wall frame member shown in FIG. 1.
Figure 8:
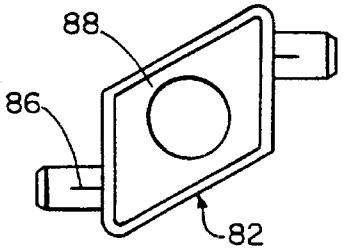
FIG. 8 is top detail view of a trolley described in detail below.

For window installations on the wall of a building, the top member 12 (FIG. 4) comprises a downwardly-open U-channel 24 having a base 26 with integral wings 28,30 extending to one side. Each wing has a foot 32 or 34 forming a vertical surface which goes against the wall surface. A broad extension flange 36, parallel to the wings, extends from one arm of the "U" to the opposite side, that is, away from the wall. Smaller internal flanges 38 on either arm of the "U" define a gap 40 therebetween about 0.7 inch wide. Each internal flange has a small inturned lip 42 at its free edge, and a raised, grooved, track element 44 running parallel to the lip, hidden inside the channel.

Figure 5:
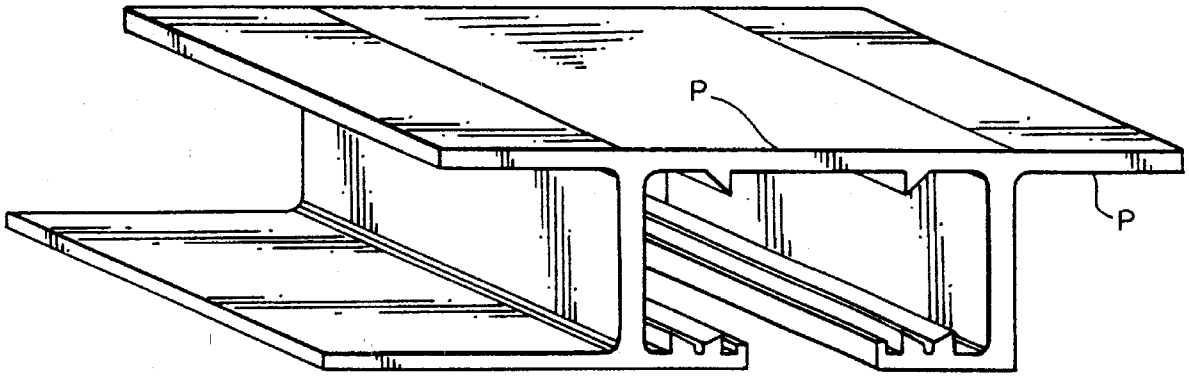
FIG. 5 s a perspective view of a ceiling track member used in certain applications other than FIG. 1.
Figure 6:
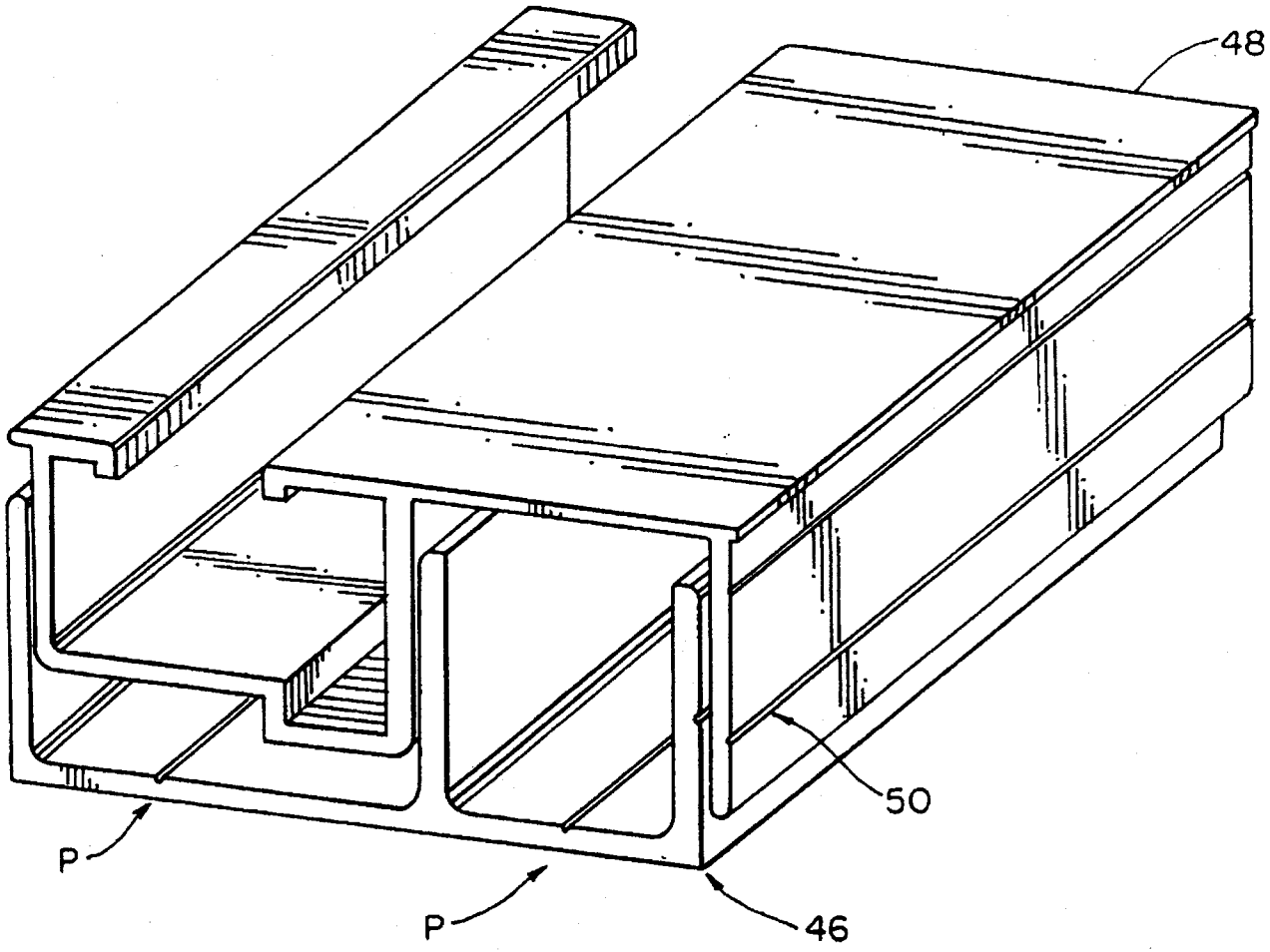
FIG. 6 is a perspective view of a floor track member used in application other than that of FIG. 1.
Figure 7:
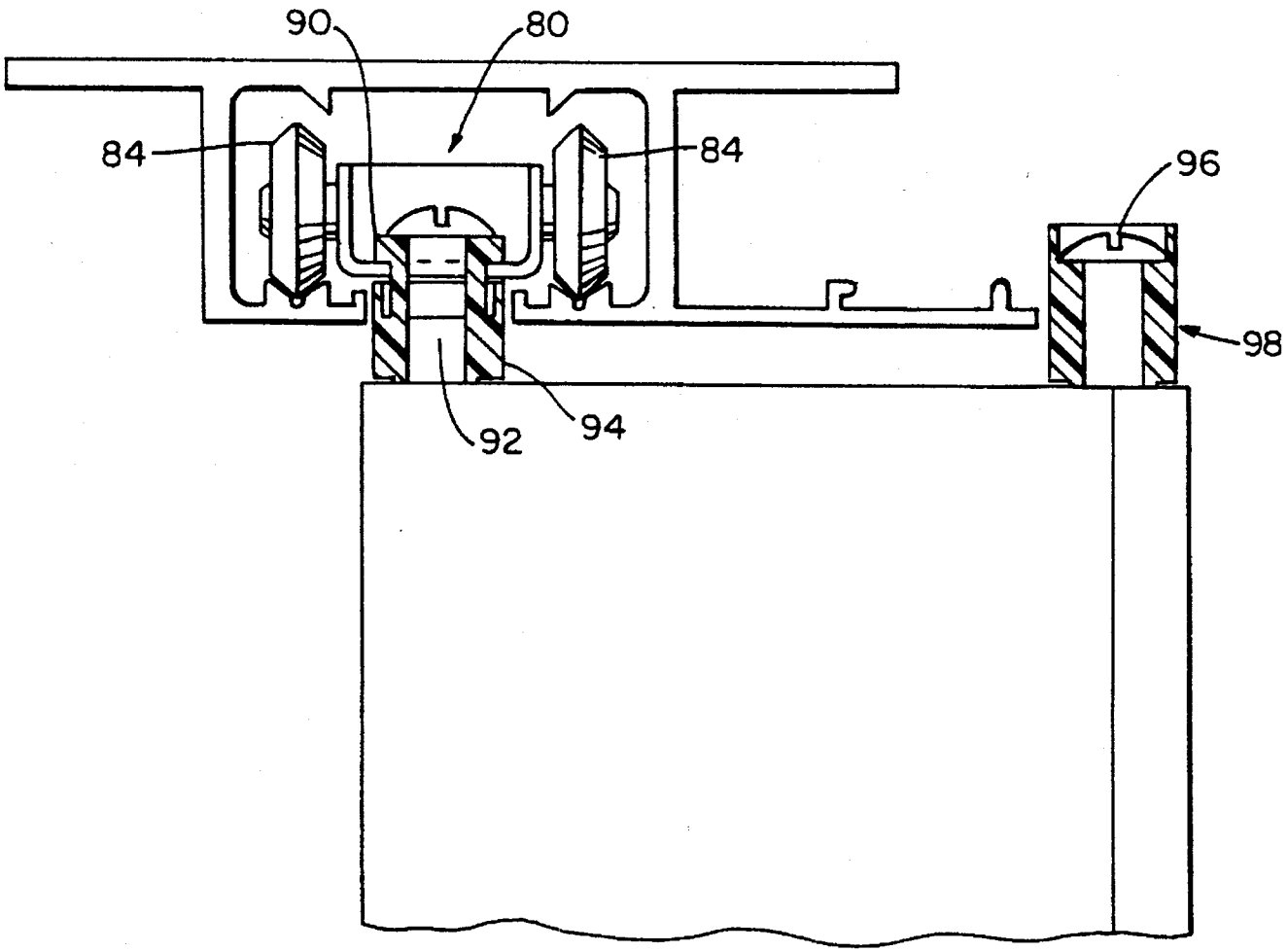
FIG. 7 is a sectional view on a vertical plane through the shutter frame of FIG. 1, showing how the shutter blades are suspended in the frame.
Figure 9:
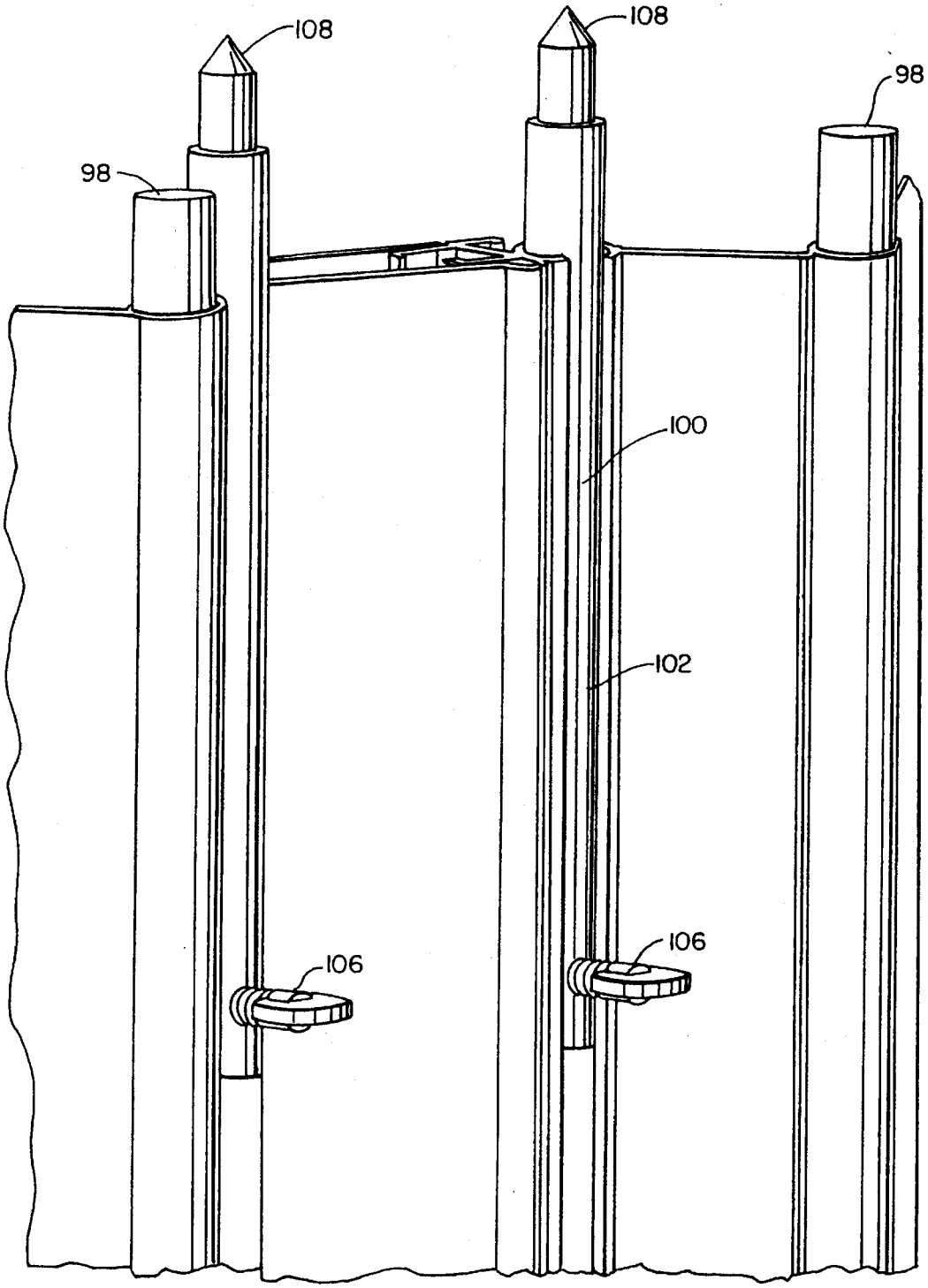
FIG. 9 is a an isometric view of a top portion of the shutter, without its frame, showing locking pins for securing the shutters.

For window installations, the bottom member 18 of the frame is identical to the top member, except inverted, so that the gap faces upward.

Where a track has to be installed on an existing ceiling or floor, the design of the top and bottom members is modified, as shown in FIGS. 5 and 6. The ceiling member shown in FIG. 5 is like the element previously described, except that the wings are now on either side of the channel, for flush mounting to the ceiling.

The floor member shown in FIG. 6 is an assembly of two parts: an "E" channel anchor base 46 having narrow and wider recesses separated by a partition corresponding to the middle arm of the "E" and a cover 48 which nests within the anchor base The cover comprises a "U" channel having internal, lipped flanges 42 at the tips of its arms (like the top member), and an integral "L" section 50 extending along one side. The channel portion of the cover is sized to fit within the large recess of the anchor base, and the "L" section extends just outside the remaining leg of the anchor base.

Regardless of the type of installation, the top and bottom members are affixed to the structure at points "P" by fasteners not shown. The side members 14,16 each have a flat mounting portion which can be attached directly to the structure, or via "L" section channel members, if necessary. Each wing panel is an extruded member having a hinge joint socket or knuckle formed along its free vertical edge. Details of the hinge joints are described further below.

Figure 1:
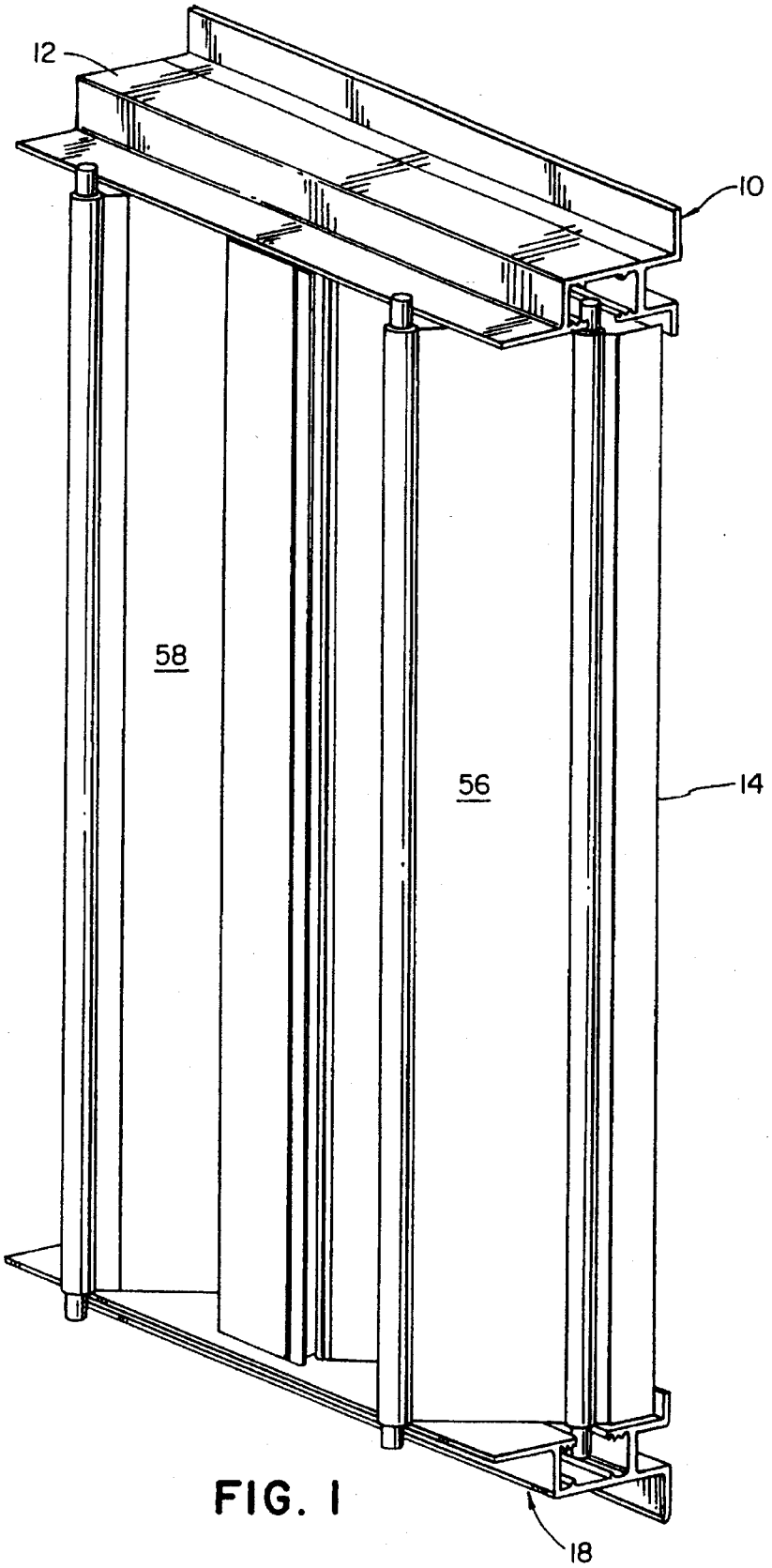
FIG. 1 is a perspective view of an accordion storm shutter assembly embodying the invention, as seen from outside the building.
Figure 2:
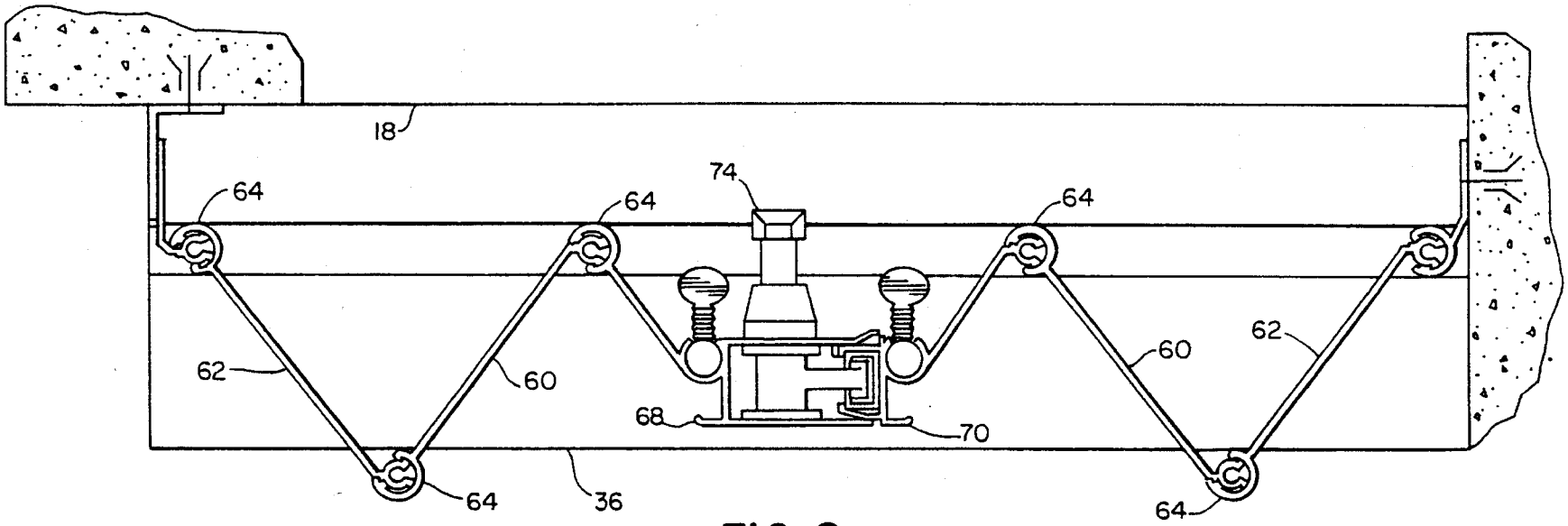
FIG. 2 is a top plan section thereof, taken on a horizontal plane.
Figure 3:
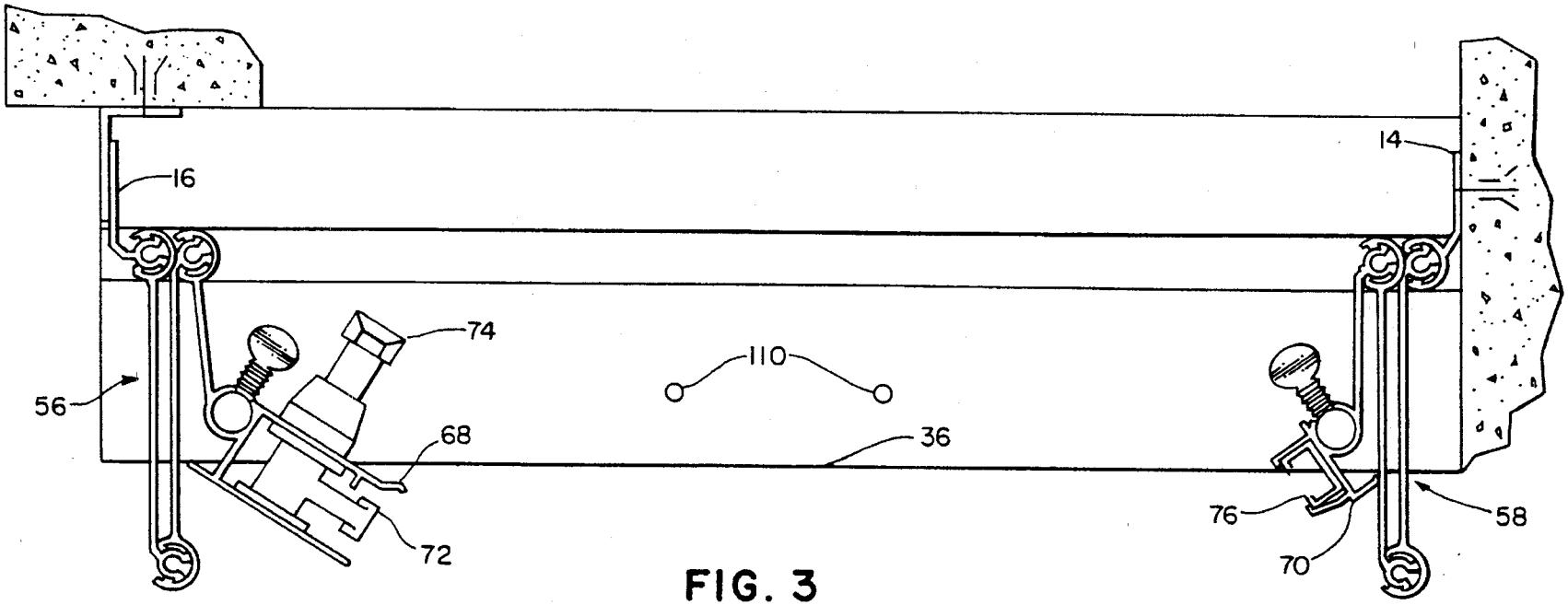
FIG. 3 is a view corresponding to FIG. 2, showing the shutters open.

Now, as one can see from FIG. 1, the frame contains a pair of shutters 56,58 which can be drawn laterally from an open position (FIG. 3) to a closed position (FIGS. 1 and 2). Each shutter comprises at least two extruded aluminum alloy blades 60,62, which are articulated by hinges 64. The outer blade 62 is connected by a similar hinge to one of the wing panels 14,16. The inner blade 60 is hinged to a respective jamb panel. The jamb panels 68,70 have different geometries: one (68) is adapted to contain a latch mechanism 72, whose handle 74 protrudes into the living space; the other (70) contains a catch 76 engaged by the latch. Selection of a suitable latch assembly is a matter of ordinary skill.

The shutters are suspended from the top frame member by trolleys 80, each comprising a rhomboidal hub 82 supporting a pair of wheels 84 which straddle the opening in the channel and ride in the respective tracks. The horizontal axles 86 on which the wheel are mounted are horizontally offset so that one leads the other. Each hub has a center hole 88 through which a retaining plug 90 extends. The plug has a reduced-diameter portion 92 which fits inside a counterbored bushing 94 whose outer diameter is almost as great as the width of the gap in the top member 12. A three-inch long #14 sheet metal screw 96 is passed through both the plug and bushing and threaded into the center of the inner hinge member, to retain the parts.

So that the shutter can fold, only alternating hinge joints are confined within the gaps in the top and bottom frame members by the plugs and bushings mentioned. See FIG. 2, for example. The other remaining hinges are provided with a simpler nylon spacer sleeve 98, counterbored at the top, which is held in place by a sheet metal screw threaded lengthwise into the knuckle. The shutter geometry is designed so that, when the shutter is closed, the spacer sleeves 98 bear against the extension flanges 36 of the top and bottom members. The additional bearing points provide added resistance to wind pressures.

Further protection, against both break-ins and storm forces, is provided by four latch bolts 100, two in either jamb member, top and bottom. Each latch bolt comprises a cylindrical slider 102. A thumb screw 106, threaded into a hole in the slider and protruding inwardly therefrom, provides means by which one can move the slider. Tightening the screw locks the bolt in position. A tapered latch pin 108 protrudes from one end of the latch bolt (upwardly, for the upper bolts, downwardly for the lower bolts). During installation, holes 110 are custom-drilled at appropriate positions (see FIG. 3) in the upper and lower members, to receive the latch pins.

In use, once the shutters have been drawn closed, the latch bolts are slid toward the respective top and bottom frame members, into the receiving holes 110. Now, wind pressure forces and impact forces on the shutter are transferred, in part, via the bolt holes to the frame members, and the shutters are kept closed, even if the latch is broken or fails.

Part of wind forces on the blades also are transferred to the upper and lower members via the hinge pins and bushings, contacting the lips of the upper and lower members, or the inwardly protruding wings. The remaining portion of such forces are delivered via the side members to the structure's wall.

Figure 10:
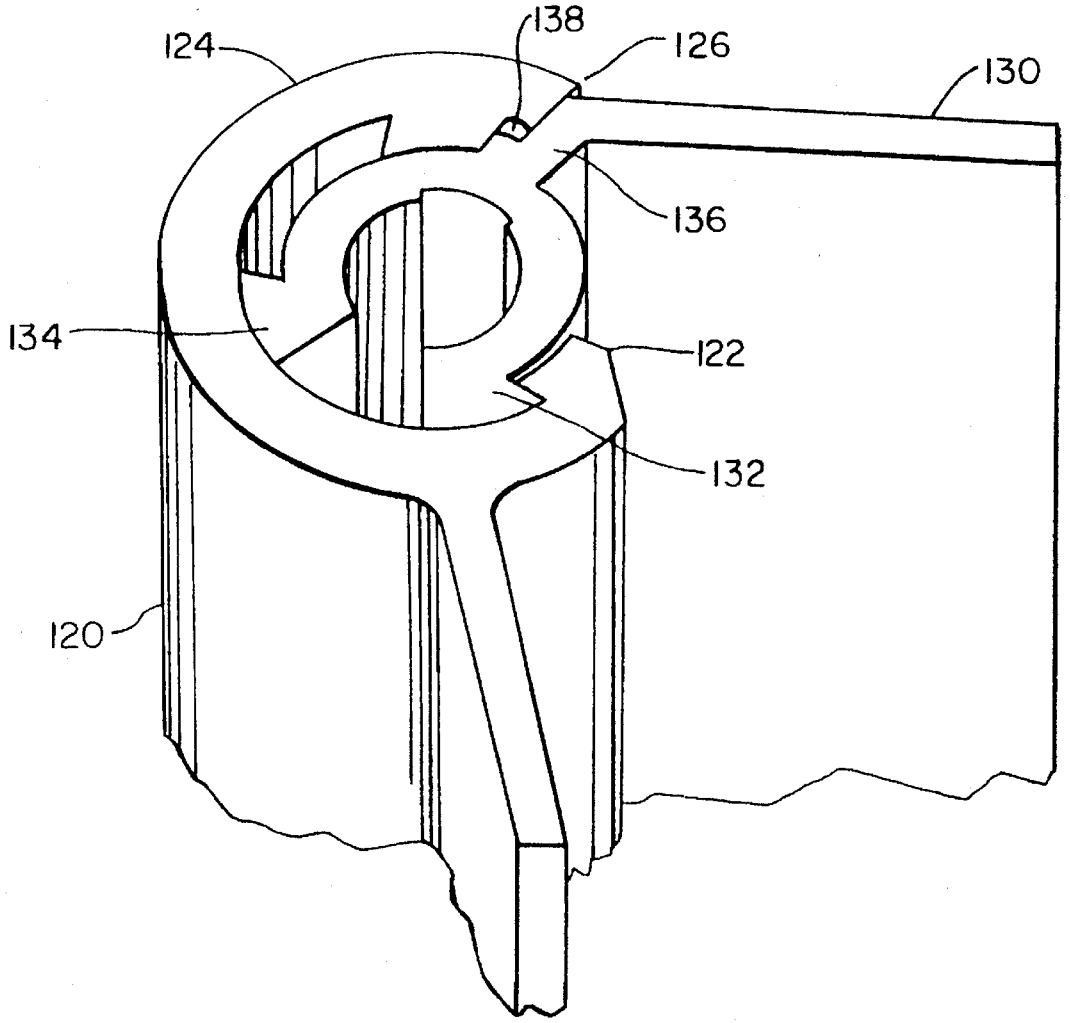
FIG. 10 is a perspective view of the upper end of an articulated hinge connection between adjacent blade elements.

The structure of the hinges themselves is important to the success of the shutter. As can be seen in FIG. 10, each hinge comprises a female cylindrical socket 120 and a smaller male knuckle 130 which can turn over a limited arc within the socket. The socket has two internal ribs 122,124, running lengthwise, and the sleeve has two external ribs 132,134 which engage the internal ribs at either extreme of motion. At maximum flexion (blades about parallel, FIG. 3), the blade arm 136 strikes the distal side of rib 122, while the proximal side surfaces of ribs 124 and 134 abut. At maximum extension (about 75° between blades, FIGS. 1 and 2), the blade arm 136 strikes the plain edge 126 of the socket; simultaneously, a small shoulder 138 on the knuckle engages the distal edge of rib 124, while the ribs 122 and 132 bear against one another. The resulting three-point (actually three-line) contact provides high strength, more than adequate to prevent hinge failure. It can be seen as well that the interengaging shoulders of the ribs have a positive rake (in the range of 15°–30°), which ensures that the ribs will not slide over one another and disengage under heavy loads.

Neighboring blades are assembled by sliding the knuckle of one lengthwise into the socket of the other. We presently prefer to use an extruded 6005-T6 aluminum alloy for the frame members, and a high-strength 6063-T6 for the blades. Other materials may prove suitable, or even preferable, in various applications of this invention. Blades 0.062 inch thick, whose hinge sockets and knuckles have walls substantially thicker than the blades, test well in excess of the code specifications mentioned above, when the angle between blades (shutters closed) is about 75°. Angles less than 90° should provide adequate strength. In any event, the angle between blades should be substantially below 180°.

Since the invention is subject to modifications and variations, it is intended that the foregoing description and the accompanying drawings shall be interpreted as illustrative of only one form of the invention, whose scope is to be measured by the following claims.

I claim:

1. In an accordion storm shutter assembly comprising a frame for installation in an opening in a building wall and at least one folding shutter supported by the frame and comprising plural blades articulated along vertical edges whereby the shutter can fold from a closed position in which the blades make a substantial angle with one another so as to have a corrugated configuration blocking the opening, to an open position in which the blades are substantially parallel to one another, the improvement wherein neighboring blades subtend an angle of substantially less than 180° when the shutter is closed, and said blades are interconnected to one another by linear hinges, each comprising a socket which is substantially an arc of a cylindrical shell having a vertical axis, said socket having a longitudinal gap, and a knuckle adapted to turn within the socket and having a blade arm extending from the knuckle through the gap, the blades being extruded members of uniform cross-section, and the socket and the knuckle both being integrally formed along respective edges of said blades, wherein the socket has two internal, longitudinally extending ribs, and the knuckle has two external, longitudinally extending ribs for engaging the respective internal ribs at either extreme of rotation, and a shoulder for engaging one of said internal ribs and providing a further limit stop in the closed position.

2. The invention of claim 1 wherein said angle is less than 90°.

3. The invention of claim 1, wherein said angle is about 75°.

4. The invention of claim 1, wherein the blade arm contacts an either edge of the socket gap, providing a further limit stop at either extreme of motion.

5. The invention of claim 1, wherein the shutters are suspended from the top frame member by a plurality of trolleys, each comprising a hub pivotally connected to one of the hinge joints, and a pair of wheels, which ride on the top frame member.

6. The invention of claim 5, wherein on each trolley, the wheels are mounted on offset axles, so that one leads the other.

7. The invention of claim 5, wherein the trolley is connected to the hinge joint by an elongate fastener, and further comprising, around the fastener, a bushing which rides in a gap running lengthwise in the top frame member.

8. The invention of claim 7, wherein the bottom frame member has a lengthwise gap opposite that in the top member, and the shutters have, secured to the bottom of the hinge joints, bushings which ride in the lower gap.

9. The invention of claim 7, wherein each shutter comprises a jamb member, and further comprising a latch for interconnecting the jamb members when the shutter is closed.

10. The invention of claim 7, further comprising two pairs of latch bolts, one at the top of each jamb member, and one at the bottom thereof, mounted for sliding movement therein, each latch bolt having a pin protruding vertically toward a hole in a respective frame member, the holes being disposed in the path of the pins when the shutter is closed.

* * * * *